US011747743B2

(12) United States Patent
Ichihashi et al.

(10) Patent No.: US 11,747,743 B2
(45) Date of Patent: Sep. 5, 2023

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Naoaki Ichihashi, Chiba (JP); Kenichi Ikari, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 372 days.

(21) Appl. No.: 17/199,024

(22) Filed: Mar. 11, 2021

(65) Prior Publication Data

US 2021/0302847 A1 Sep. 30, 2021

(30) Foreign Application Priority Data

Mar. 26, 2020 (JP) ..... 2020-056468

(51) Int. Cl.
*G03G 5/02* (2006.01)
*G03G 15/00* (2006.01)
*G03G 21/18* (2006.01)

(52) U.S. Cl.
CPC ..... *G03G 5/02* (2013.01); *G03G 15/75* (2013.01); *G03G 21/1803* (2013.01)

(58) Field of Classification Search
CPC ..... G03G 5/14–153; G03G 15/161; G03G 15/162
See application file for complete search history.

(56) References Cited

U.S. PATENT DOCUMENTS 7,622,238 B2 11/2009 Uematsu
7,813,675 B2 * 10/2010 Tanabe ..... G03G 5/043 430/66
8,886,092 B2 * 11/2014 Saito ..... G03G 5/147 399/159
9,389,521 B2 7/2016 Takahashi et al.
9,766,561 B2 9/2017 Takahashi et al.
9,772,596 B2 * 9/2017 Mitsui ..... G03G 5/0525
9,817,324 B2 11/2017 Kitamura et al.
9,971,258 B2 5/2018 Kitamura et al.
(Continued)

FOREIGN PATENT DOCUMENTS

JP 4059518 B2 12/2007

OTHER PUBLICATIONS

U.S. Appl. No. 17/205,440, Kenichi Ikari, filed Mar. 18, 2021.

*Primary Examiner* — Leon W Rhodes, Jr.
(74) *Attorney, Agent, or Firm* — VENABLE LLP

(57) ABSTRACT

A cylindrical electrophotographic photosensitive member having concave portions on a surface thereof includes a region A having concave portions at an end portion in an axial direction of the photosensitive member and a region B having concave portions different from those in the region A in a direction toward a center of the axial direction of the photosensitive member from the region A, wherein in the region A, an average value L1 is 20 to 200 μm, an average value W1 satisfies W1≤L1, an average value d1 is 1.7 to 4.0 μm, and an area ratio a1 is 5 to 65%; and in the region B, an average value L2 is 20 to 200 μm, an average value W2 satisfies W2≤L2, an average value d2 is 0.3 to 1.5 μm, and an area ratio a2 is 5 to 65%.

6 Claims, 10 Drawing Sheets

(56) References Cited

U.S. PATENT DOCUMENTS

| | | | | |
|---|---|---|---|---|
| 10,042,273 | B2 | 8/2018 | Takahashi et al. | |
| 10,359,729 | B2 | 7/2019 | Ichihashi et al. | |
| 10,895,840 | B2 | 1/2021 | Ichihashi et al. | |
| 11,269,282 | B2 * | 3/2022 | Ikari ..... | G03G 5/056 |
| 2020/0341394 | A1 | 10/2020 | Ikari et al. | |

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member, a process cartridge and an electrophotographic apparatus.

Description of the Related Art

An electrical external force and a mechanical external force such as electrification and cleaning are added onto the surface of a cylindrical electrophotographic photosensitive member (hereinafter, also simply referred to "electrophotographic photosensitive member"), and accordingly, the surface is required to have durability (abrasion resistance and the like) against these external forces.

Furthermore, the usage environment of the electrophotographic apparatus is diversified, and an electrophotographic apparatus and a process cartridge are desired which have a long life and high stability in all environments.

In response to these demands, an improvement technology has been conventionally used in which a resin having high abrasion resistance (a curable resin or the like) is used for a surface layer of the electrophotographic photosensitive member.

On the other hand, as a main problem which is caused by enhancing the abrasion resistance of the surface of the electrophotographic photosensitive member, there is an influence on a performance of the cleaning which is performed by a cleaning blade.

The influence on the cleaning performance means problems such as an increase of a driving torque, which occurs due to an increase of the frictional force between the surface of the electrophotographic photosensitive member having a high abrasion resistance and the cleaning blade, passing of a toner due to minute vibration of the cleaning blade, a squeaking of the cleaning blade, and the reversal of the cleaning blade.

In order to solve these problems, there is a technology of forming an uneven shape on a surface of an electrophotographic photosensitive member, by pressing a mold member having the uneven shape on its surface against the electrophotographic photosensitive member. Japanese Patent No. 4059518 discloses a method for controlling a fine shape to be transferred to the surface of the electrophotographic photosensitive member with high accuracy. This method is excellent in viewpoint of the diversity and controllability of the shape to be transferred. The method is also excellent in reducing a frictional force which is generated between the surface of the electrophotographic photosensitive member and the cleaning blade.

SUMMARY OF THE INVENTION

Important factors in the electrophotographic apparatus for a cleaning performance of the cleaning blade to be maintained over a long period of time include homogenization of the stress to be applied to the cleaning blade.

In an axial direction of the electrophotographic photosensitive member, the progress of deterioration and abrasion of the electrophotographic photosensitive member does not become equal, due to the influence of peripheral members which are in contact with and opposed to the electrophotographic photosensitive member.

In order to further extend the life of the electrophotographic apparatus in the future, it is required to achieve both of the homogenization of the stress to be applied to the cleaning blade in the longitudinal direction and the reduction of the frictional force which is generated between the surface of the electrophotographic photosensitive member and the cleaning blade. In order to solve such problems, it is required to optimize a state of a rough face of the surface of the electrophotographic photosensitive member.

At least one of aspects of the present disclosure is directed to providing an electrophotographic photosensitive member which can prolong the lives of the cleaning blade, process cartridge and electrophotographic apparatus. Further, another one of aspects of the present disclosure is directed to providing a process cartridge and an electrophotographic apparatus having the electrophotographic photosensitive member.

According to at least one of aspects of the present disclosure, there is provided an electrophotographic photosensitive member according to the present disclosure is a cylindrical electrophotographic photosensitive member having a plurality of concave portions on a surface thereof, including:

a region A having a plurality of concave portions at an end portion in an axial direction of the electrophotographic photosensitive member; and a region B having a plurality of concave portions different from those in the region A, in a direction toward a center of the axial direction of the electrophotographic photosensitive member from the region A, wherein in the region A, an average value L1 of maximum widths of opening parts of the concave portions in a circumferential direction of the electrophotographic photosensitive member is 20 μm to 200 μm, an average value W1 of maximum widths of opening parts of the concave portions in an axial direction of the electrophotographic photosensitive member satisfies $W1 \leq L1$, an average value d1 of depths of the concave portions is 1.7 μm to 4.0 μm, and an area ratio a1 of the concave portions is 5% or more and 65% or less; and in the region B, an average value L2 of maximum widths of opening parts of the concave portions in a circumferential direction of the electrophotographic photosensitive member is 20 μm to 200 μm, an average value W2 of maximum widths of opening parts of the concave portions in an axial direction of the electrophotographic photosensitive member satisfies $W2 \leq L2$, an average value d2 of depths of the concave portions is 0.3 μm to 1.5 μm, and an area ratio a2 of the concave portions is 5% or more and 65% or less.

According to another aspect of the present disclosure, there is provided a process cartridge which is detachably attachable to a main body of an electrophotographic apparatus, integrally supporting the electrophotographic photosensitive member and a cleaning unit having a cleaning blade arranged in contact with the electrophotographic photosensitive member.

According to further aspect of the present disclosure, there is provided an electrophotographic apparatus including: the electrophotographic photosensitive member; a charging unit; an exposure unit; a developing unit; a transfer unit, and a cleaning unit having a cleaning blade arranged in contact with the electrophotographic photosensitive member.

The electrophotographic photosensitive member of the present disclosure, when being used, can further reduce the frictional force between the surface of the electrophotographic photosensitive member and the cleaning blade, can homogenize the stresses in the longitudinal direction, which are applied to the cleaning blade, and can maintain a satisfactory cleaning state for a longer period of time. Accordingly, the electrophotographic photosensitive member of the present disclosure, when being used in a process cartridge or an electrophotographic apparatus, can keep the lives of a cleaning blade to be mounted, the process cartridge and the electrophotographic apparatus long.

Further features of the present invention will become apparent from the following description of exemplary embodiments with reference to the attached drawings.

DESCRIPTION OF THE EMBODIMENTS

Figure 1:
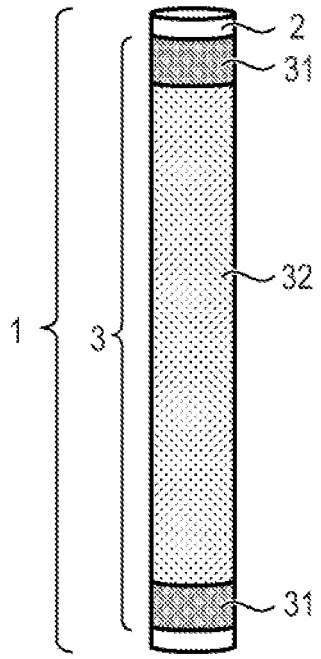
FIG. 1 illustrates a view illustrating one example of an appearance of an electrophotographic photosensitive member of the present disclosure.

Preferred embodiments of the present invention will now be described in detail in accordance with the accompanying drawings.

An electrophotographic photosensitive member according to the present disclosure is a cylindrical electrophotographic photosensitive member having a plurality of concave portions on its surface, including:

a region A having a plurality of concave portions at an end portion in an axial direction of the electrophotographic photosensitive member; and a region B having a plurality of concave portions different from those in the region A, in a direction toward a center of the axial direction of the electrophotographic photosensitive member from the region A, wherein in the region A, an average value L1 of maximum widths of opening parts of the concave portions in a circumferential direction of the electrophotographic photosensitive member is 20 μm to 200 μm, an average value W1 of maximum widths of opening parts of the concave portions in an axial direction of the electrophotographic photosensitive member satisfies $W1 \leq L1$, an average value d1 of depths of the concave portions is 1.7 μm to 4.0 μm, and an area ratio a1 of the concave portions is 5% or more and 65% or less; and in the region B, an average value L2 of maximum widths of opening parts of the concave portions in a circumferential direction of the electrophotographic photosensitive member is 20 μm to 200 μm, an average value W2 of maximum widths of opening parts of the concave portions in the axial direction of the electrophotographic photosensitive member satisfies $W2 \leq L2$, an average value d2 of depths of the concave portions is 0.3 μm to 1.5 μm, and an area ratio a2 of the concave portions is 5% or more and 65% or less.

The area ratios a1 and a2 of the concave portions each mean a ratio of an area on the surface of the electrophotographic photosensitive member in a region in which a depressed portion is surrounded by a line in contact with a flat portion in its periphery, to the whole area of the surface of the electrophotographic photosensitive member, when the concave portions existing in regions A and B are viewed down from directly above the surface of the electrophotographic photosensitive member. The determination of the opening areas of these concave portions will be described later in detail.

The main difference between the electrophotographic photosensitive member of the present disclosure and a conventionally known electrophotographic photosensitive member having concave portions on its surface will be described below.

In the viewpoint of further reducing the frictional force with the cleaning blade, a feature of a surface of the conventionally known electrophotographic photosensitive member is that a more uniform shape is stably provided over the whole surface. The more uniform shape means that a depth of a concave portion is equal to those of surrounding concave portions. In addition, the term "stable over the whole surface" means that the particular concave portion does not exist in which the depth of the concave portion is short compared to those in the surroundings, on the surface of the electrophotographic photosensitive member, particularly in a range in contact with the cleaning blade.

On the surface of the conventionally known electrophotographic photosensitive member having concave portions on its surface, concave portions each having uniform depth are stably provided over the whole surface, and the concave portions can reduce friction with the cleaning blade. When the concave portion is shallow, the cleaning blade is in contact with the bottom of the concave portion. However, as the depth of the concave portion increases, the cleaning blade becomes unable to come in contact with the bottom of the concave portion, and it becomes difficult for the cleaning blade to always clean a toner and an external additive. In this case, passing of a toner and an external additive occurs due to the toner or the external additive which remains in the concave portion.

As described above, the depth of the concave portion is designed so as to achieve both of reduction in the frictional force with the cleaning blade, and suppression of the passing of the toner and the external additive.

Furthermore, the electrophotographic photosensitive member has a region in which the presence or absence of a member is different which comes in contact with and opposes to the electrophotographic photosensitive member, at an end portion in the axial direction. Specifically, a charging roller, a developing roller, an intermediate transfer belt and the cleaning blade have each different length, and accordingly the lengths of the members which come in contact with and oppose to the electrophotographic photosensitive member are each different in the axial direction thereof. As a result, on the surface of the electrophotographic photosensitive member, there are regions in which deterioration progresses due to charging and in which the deterioration does not progress, depending on the presence or absence of the charging roller. In addition, there are regions in which grinding by the toner or the external additive occurs and in which the grinding does not occur, depending on the presence or absence of the developing roller. Because of these combinations, there exists a region in which the deterioration of the charged electrophotographic photosensitive member progresses due to electric discharge, the grinding by the toner or the external additive does not occur because the region is outside the development range, and as a result, the progress of the deterioration is remarkable.

As described above, when the surface of the electrophotographic photosensitive member is viewed in the axial direction, it is apparent that the progress of the deterioration and abrasion of the surface due to repetition of the printing process is not equal.

As a result, the stress applied to the cleaning blade becomes inhomogeneous in the longitudinal direction.

On the other hand, a main feature (configuration) of the electrophotographic photosensitive member according to the present disclosure is that the electrophotographic photosensitive member has a specific region A which has a plurality of concave portions at an end portion in the axial direction of the electrophotographic photosensitive member, and a specific region B which has a plurality of concave portions different from those in the region A in a direction closer to the center than the region A in the axial direction thereof.

The purpose to make the electrophotographic photosensitive member have such different regions is to homogenize the stress in the longitudinal direction of the cleaning blade. At an end portion in the axial direction of the electrophotographic photosensitive member, there is a region in which the progress of the deterioration is remarkable as described above, and accordingly, the stress of the cleaning blade increases which comes in contact with this region.

Then, deeper concave portions are arranged at the end portion in the axial direction of the electrophotographic photosensitive member, which is regarded as the specific region A, and shallower concave portions are arranged in the middle which is regarded as the specific region B, so as to solve this problem.

An image formable region is located closer to the middle of the electrophotographic photosensitive member in the axial direction, and in this region, all members exist which come in contact with and oppose to the electrophotographic photosensitive member; and accordingly, the region to be focused on for solving the problem exists outside the image formable region. Therefore, it is preferable in the present disclosure that the region A be arranged outside the image formable region.

The electrophotographic photosensitive member of the present disclosure will be described in more detail with reference to the drawings. FIG. 1 is a view illustrating an appearance of one example of an electrophotographic photosensitive member of the present disclosure, and as is illustrated in FIG. 1, a cylindrical electrophotographic photosensitive member 1 has a cylindrical base substance 2 and a surface layer 3 provided on the surface thereof. In addition, a large number of concave portions are provided on the surface of the surface layer 3.

The electrophotographic photosensitive member has on the surface thereof, two regions, i.e., a region A and a region B, and different types of concave portions exist in the two regions, respectively; and the electrophotographic photosensitive member 1 has regions A 31 at end portions in the axial direction thereof and has a region B 32 in a direction closer to the center than the regions A 31.

The concave portions may be provided in the same range as the surface layer 3 in the axial direction of the electrophotographic photosensitive member 1; or may be provided in a range corresponding to an approximate length with which the cleaning blade comes into contact, even though the range is shorter than the range of the surface layer 3.

Here, determination (definition) of the concave portion, the flat portion and the like on the surface of the cylindrical electrophotographic photosensitive member of the present disclosure will be described.

Figure 2:
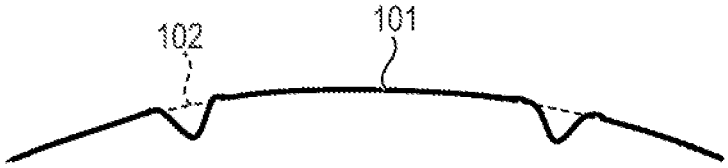
FIG. 2 illustrates a view illustrating one example of fitting of a concave portion on the surface of the electrophotographic photosensitive member of the present disclosure.

First, the outer peripheral surface of the electrophotographic photosensitive member is magnified by a microscope and is observed. The outer peripheral surface of the electrophotographic photosensitive member forms a curved surface that is curved in the circumferential direction, and accordingly, the cross-sectional profile of the curved surface is extracted, and the curve (arc) is subjected to fitting. FIG. 2 illustrates an example of the fitting. The example illustrated in FIG. 2 is an example in which the electrophotographic photosensitive member is cylindrical. In FIG. 2, a solid line 101 indicates the cross-sectional profile of the peripheral surface (curved surface) of the electrophotographic photosensitive member, and a broken line 102 indicates a curve that is fitted to the cross-sectional profile 101. The cross-sectional profile 101 is corrected so that the curve 102 becomes a straight line, and the plane is defined as a reference plane, which has been obtained by extending the obtained straight line in the longitudinal direction (direction orthogonal to the circumferential direction) of the electrophotographic photosensitive member. When the electrophotographic photosensitive member is not cylindrical, the reference plane is obtained in the same manner as in the case of the cylindrical member.

A portion that is located below the obtained reference plane is defined as the concave portion. A distance from the reference plane to the lowest point of the concave portion is defined as the depth of the concave portion. An opening formed by each of the concave portions in the reference plane is defined as an opening part, and a length of the longest line segment among line segments crossing the opening part in the axial direction is defined as the width W of the opening part of the concave portion in the axial direction. Similarly, a length of the longest line segment among line segments crossing the opening part in the circumferential direction is defined as the maximum width L of the opening part in the circumferential direction.

Next, the concave portion of the region A and the concave portion of the region B will be each described.

An average value L1 of the maximum widths of the opening parts in the circumferential direction of the electrophotographic photosensitive member of all the concave portions in the region A is 20 μm to 200 μm. In addition, an average value W1 of the widths of the opening parts in the axial direction of the electrophotographic photosensitive member of all the concave portions in the region A satisfies the following expression:

$$W1 \leq L1.$$

The average value d1 of the depths of all the concave portions in the region A is 1.7 μm to 4.0 μm.

The area ratio a1 of the concave portions in the region A is 5% or more and 65% or less.

Due to the concave portions in the region A being in these ranges, the electrophotographic photosensitive member can effectively obtain an effect of reducing the friction with the cleaning blade. The area ratio a1 of the concave portions in the region A is particularly preferably 40% or more and 65% or less. By doing so, the electrophotographic photosensitive member further enhances the effect of reducing the friction with the cleaning blade, and can effectively suppress the squeaking of the cleaning blade.

An average value L2 of the maximum widths of the opening parts in the circumferential direction of the electrophotographic photosensitive member of all the concave portions in the region B is 20 μm to 200 μm. In addition, an average value W2 of the widths of the opening parts in the axial direction of the electrophotographic photosensitive member of all the concave portions in the region B satisfies the following expression:

$$W2 \leq L2.$$

The average value d2 of the depths of all the concave portions in the region B is 0.3 μm to 1.5 μm.

The area ratio a2 of the concave portions in the region B is 5% or more and 65% or less.

Due to the concave portions in the region B being in these ranges, the electrophotographic photosensitive member can effectively suppress the occurrence of the passing of the toner and the external additive.

The electrophotographic photosensitive member of the present disclosure has the region A at its end portion in the axial direction. The electrophotographic photosensitive member may have the region A at one end portion, and has the region A preferably at both end portions.

As for the specific position of the end portion, when a length of the axial direction of the electrophotographic photosensitive member is defined as 1.00, and the position on the electrophotographic photosensitive member in the axial direction is represented by a value of 0.00 to 1.00, it is preferable that the position on the electrophotographic photosensitive member including the region A in the axial direction be 0.02 to 0.08 or 0.92 to 0.98. The position of the region A may be a part of this numerical range, and is more preferably the whole of the range.

The electrophotographic photosensitive member of the present disclosure has the region B in the central portion in the axial direction. When a length of the axial direction of the electrophotographic photosensitive member is defined as 1.00, and the position on the electrophotographic photosensitive member in the axial direction is represented by a value of 0.00 to 1.00, it is preferable that the position on the electrophotographic photosensitive member including the region B in the axial direction be 0.08 to 0.92, in a relation with the region A.

Figure 3A:
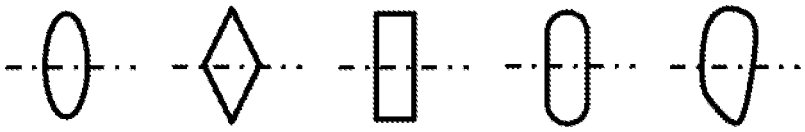
FIG. 3A illustrates a view illustrating one example of a shape of an opening part of the concave portion on the surface of the electrophotographic photosensitive member of the present disclosure.
Figure 3B:
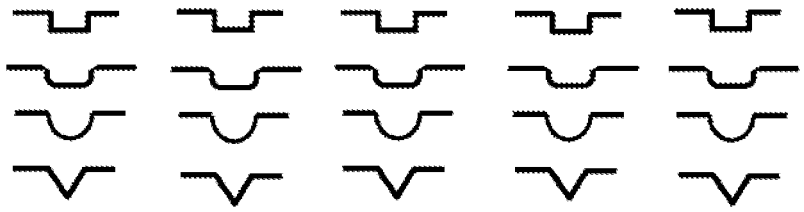
FIG. 3B illustrates a view illustrating one example of a shape of a cross section of the concave portion on the surface of the electrophotographic photosensitive member of the present disclosure.

A shape of the concave portion is not particularly limited which is provided on the surface of the electrophotographic photosensitive member. FIG. 3A illustrates an example of the shape of the opening part of the concave portion. Examples of the shape of the opening part of the concave portion include a circle, an ellipse, a square, a rectangle, a triangle, a pentagon and a hexagon. In addition, an example of the cross-sectional shape of the concave portion is illustrated in FIG. 3B. Examples of the cross-sectional shape of the concave portion include: a shape formed of a curve such as a substantially semicircle; a waveform formed of a continuous curve; a shape having an edge such as a triangle, a quadrangle or a polygon; and a shape in which the edge of the triangle, the quadrangle or the polygon is partially or wholly deformed into a curved line.

The shape of the concave portion is more preferably the following specific concave portion shape. The specific concave portion shape is a shape in which a contour of the opening part of the concave portion has an apex having an angle $\alpha$ which exceeds 0° and is 90° or less, at least on an upstream side in a rotation direction of the electrophotographic photosensitive member; the width of the contour of the opening part of the concave portion in the axial direction of the electrophotographic photosensitive member decreases toward the apex from the portion at which the width becomes maximum; and the depth of the concave portion decreases toward the apex from the deepest point of the concave portion, when the concave portion is viewed from the axial direction.

Figure 4A:
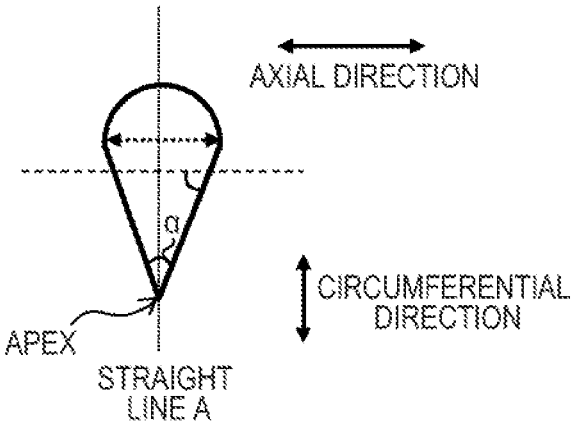
FIG. 4A illustrates a view schematically illustrating a relationship of one example of the concave portion of the present disclosure.
Figure 4B:
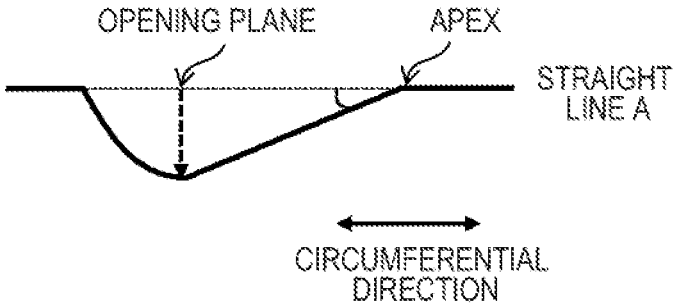
FIG. 4B illustrates a view schematically illustrating a relationship of one example of the concave portion of the present disclosure.
Figure 5A:
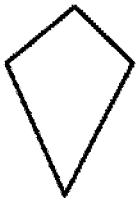
FIG. 5A illustrates a view illustrating an example of a shape of an opening part of the concave portion on the peripheral surface of the electrophotographic photosensitive member of the present disclosure.
Figure 5B:
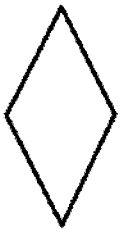
FIG. 5B illustrates a view illustrating an example of the shape of the opening part of the concave portion on the peripheral surface of the electrophotographic photosensitive member of the present disclosure.
Figure 5C:
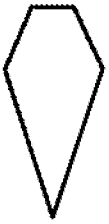
FIG. 5C illustrates a view illustrating an example of the shape of the opening part of the concave portion on the peripheral surface of the electrophotographic photosensitive member of the present disclosure.
Figure 5D:
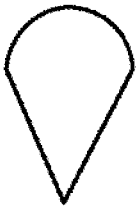
FIG. 5D illustrates a view illustrating an example of the shape of the opening part of the concave portion on the peripheral surface of the electrophotographic photosensitive member of the present disclosure.
Figure 5E:
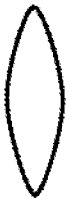
FIG. 5E illustrates a view illustrating an example of the shape of the opening part of the concave portion on the peripheral surface of the electrophotographic photosensitive member of the present disclosure.
Figure 5F:
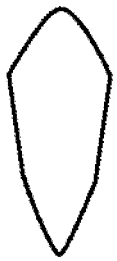
FIG. 5F illustrates a view illustrating an example of the shape of the opening part of the concave portion on the peripheral surface of the electrophotographic photosensitive member of the present disclosure.
Figure 5G:
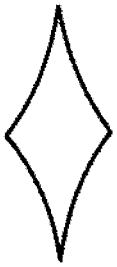
FIG. 5G illustrates a view illustrating an example of the shape of the opening part of the concave portion on the peripheral surface of the electrophotographic photosensitive member of the present disclosure.
Figure 5H:
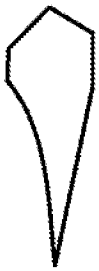
FIG. 5H illustrates a view illustrating an example of the shape of the opening part of the concave portion on the peripheral surface of the electrophotographic photosensitive member of the present disclosure.
Figure 5I:
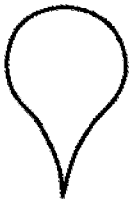
FIG. 5I illustrates a view illustrating an example of the shape of the opening part of the concave portion on the peripheral surface of the electrophotographic photosensitive member of the present disclosure.
Figure 5J:
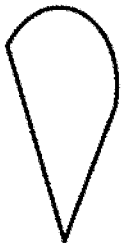
FIG. 5J illustrates a view illustrating an example of the shape of the opening part of the concave portion on the peripheral surface of the electrophotographic photosensitive member of the present disclosure.
Figure 6A:
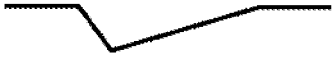
FIG. 6A illustrates a view illustrating an example of a shape of a cross-sectional portion of a concave portion on the peripheral surface of the electrophotographic photosensitive member of the present disclosure, at the time when the concave portion has been viewed from the circumferential direction.
Figure 6B:
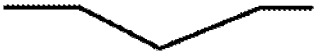
FIG. 6B illustrates a view illustrating an example of a shape of a cross-sectional portion of the concave portion on the peripheral surface of the electrophotographic photosensitive member of the present disclosure, at the time when the concave portion has been viewed from the circumferential direction.
Figure 6C:
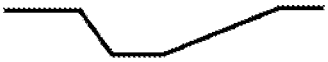
FIG. 6C illustrates a view illustrating an example of a shape of a cross-sectional portion of the concave portion on the peripheral surface of the electrophotographic photosensitive member of the present disclosure, at the time when the concave portion has been viewed from the circumferential direction.
Figure 6D:
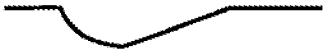
FIG. 6D illustrates a view illustrating an example of a shape of a cross-sectional portion of the concave portion on the peripheral surface of the electrophotographic photosensitive member of the present disclosure, at the time when the concave portion has been viewed from the circumferential direction.
Figure 6E:
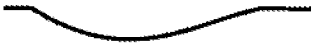
FIG. 6E illustrates a view illustrating an example of a shape of a cross-sectional portion of the concave portion on the peripheral surface of the electrophotographic photosensitive member of the present disclosure, at the time when the concave portion has been viewed from the circumferential direction.
Figure 6F:
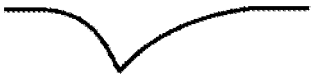
FIG. 6F illustrates a view illustrating an example of a shape of a cross-sectional portion of the concave portion on the peripheral surface of the electrophotographic photosensitive member of the present disclosure, at the time when the concave portion has been viewed from the circumferential direction.
Figure 6G:
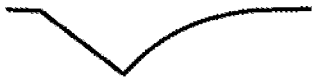
FIG. 6G illustrates a view illustrating an example of a shape of a cross-sectional portion of the concave portion on the peripheral surface of the electrophotographic photosensitive member of the present disclosure, at the time when the concave portion has been viewed from the circumferential direction.
Figure 6H:
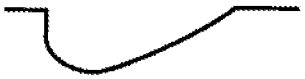
FIG. 6H illustrates a view illustrating an example of a shape of a cross-sectional portion of the concave portion on the peripheral surface of the electrophotographic photosensitive member of the present disclosure, at the time when the concave portion has been viewed from the circumferential direction.

Specifically, the specific concave portion shape is illustrated in FIGS. 4A and 4B.

The specific concave portion has an opening plane which is a virtual plane formed in a case where the specific concave portion is flush. The opening part of the specific concave portion illustrated in FIG. 4A has an apex (intersection point) formed of two straight lines on one side in the circumferential direction of the electrophotographic photosensitive member, and the other side has a semicircular shape. In addition, in the opening part, a distance to the straight line A decreases toward the apex (intersection point), from two points (positions indicated by dotted lines of arrows from the straight line A) at which the distance reaching the straight line A that passes through the apex (intersection point) in the circumferential direction is the longest. In the specific concave portion of the present disclosure, it is preferable that an angle formed by lines (two lines in total) which connect the respective points of both ends of the portion that forms the maximum width of the concave portion with the above apex and a straight line in the axial direction of the electrophotographic photosensitive member be 45° or larger and 90° or smaller. Furthermore, the angle is more preferably 620 or larger and smaller than 90°.

In addition, in the present disclosure, in a case where the line is a curved line, which forms the contour of the opening part of the concave portion, when an angle formed by the curved line and the curved line or an angle formed by the curved line and a straight line is determined, a tangent line of the curved line is used in place of the curved line. In addition, it is preferable that the above angle $\alpha$ exceeds 0° and is 58° or smaller. Furthermore, it is more preferable that the angle $\alpha$ be 56° or smaller.

Next, a cross-sectional portion of the specific concave portion shape will be described at the time when the shape has been viewed from the circumferential direction.

The cross-sectional portion of the specific concave portion shape illustrated in FIG. 4B at the time when the concave portion shape is viewed from the circumferential direction has a shape in which a depth linearly decreases toward the apex (intersection point) from the deepest point in a depth direction of the electrophotographic photosensitive member from the opening plane of the concave portion, and the other has a domed shape. In the present disclosure, it is preferable that an angle be 8.5° or smaller, which is formed by a straight line on the opening plane of the specific concave portion shape and a straight line that connects the apex (intersection point) at the time when the electrophotographic photosensitive member is projected from a side surface with the deepest point in a depth direction of the electrophotographic photosensitive member. In other words, when the specific concave portion is viewed from the axial direction, the angle is preferably 8.5° or smaller, which is formed by the straight line that connects the deepest point with the apex of the specific concave portion shape and the opening plane of the specific concave portion shape. Furthermore, it is more preferable that the angle be 3.8° or smaller.

Examples of the shape of the opening part of the specific concave portion include the shapes as illustrated in FIGS. 5A to 5J. Examples of the cross-sectional shape of the specific concave portion include the shapes illustrated in FIGS. 6A to 6H. As for a plurality of concave portions that are provided on the surface of the electrophotographic photosensitive member, concave portions having different shapes, different opening areas or different depths may be intermingled.

As a method for forming the concave portions on the surface of the electrophotographic photosensitive member, there is a method of pressing a mold member (mold) which has protruding portions corresponding to the concave portions to be formed against the surface of the electrophotographic photosensitive member, and transferring the shape.

Figure 7A:
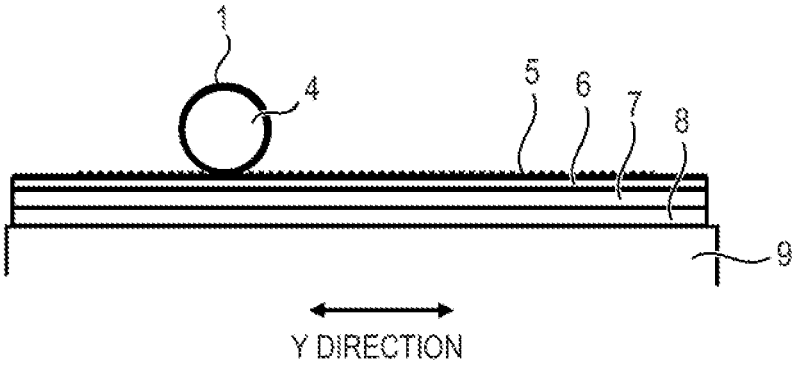
FIG. 7A illustrates one example of a method of forming the concave portions on the surface of the electrophotographic photosensitive member of the present disclosure.
Figure 7B:
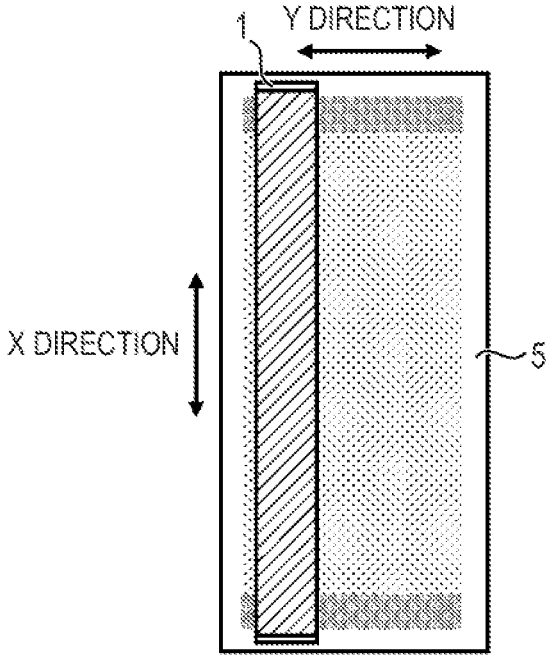
FIG. 7B illustrates one example of the method of forming the concave portions on the surface of the electrophotographic photosensitive member of the present disclosure.
Figure 8A:
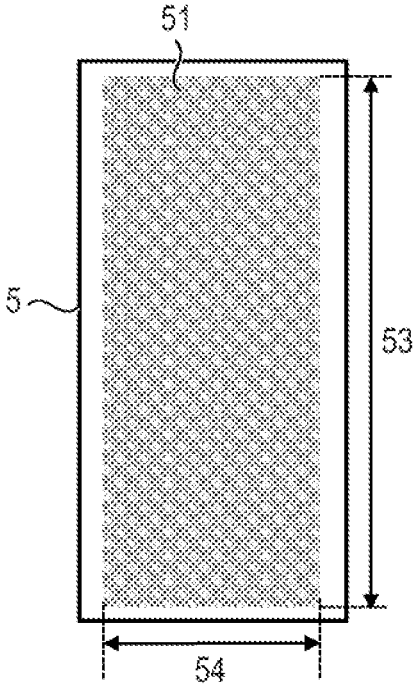
FIG. 8A illustrates one example of a mold member for forming the concave portions on the surface of the electrophotographic photosensitive member of the present disclosure.
Figure 8B:
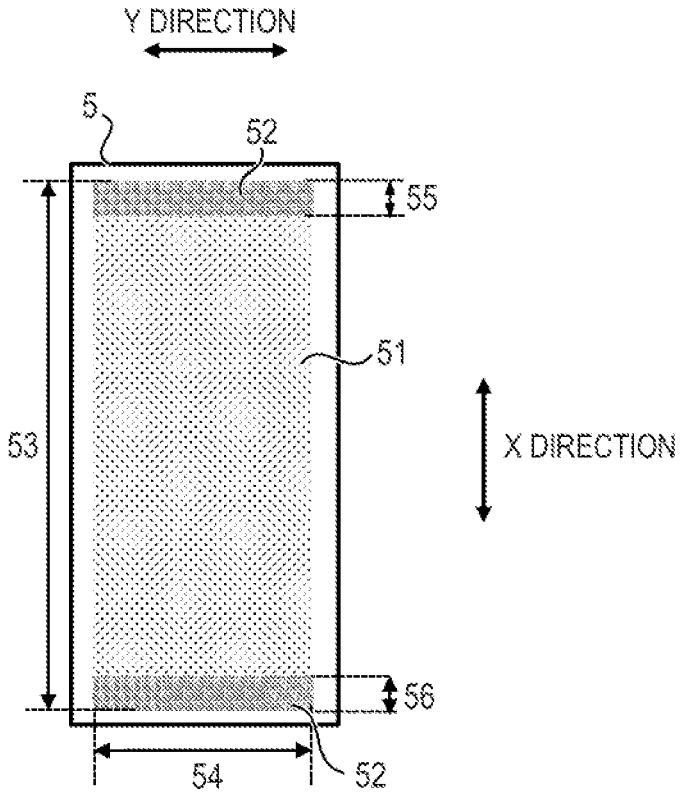
FIG. 8B illustrates one example of the mold member for forming the concave portions on the surface of the electrophotographic photosensitive member of the present disclosure.

FIGS. 7A and 7B illustrate an example of pressure-contact shape transfer processing apparatuses for forming the concave portions on the surface of the electrophotographic photosensitive member. FIG. 7A illustrates a side view schematically illustrating the pressure-contact shape transfer processing apparatus, and FIG. 7B illustrates a top view schematically illustrating the pressure-contact shape transfer processing apparatus. In addition, FIGS. 8A and 8B illustrate one example of mold members for forming concave portions on the surface of the electrophotographic photosensitive member. FIGS. 8A and 8B illustrate top views schematically illustrating mold members for forming the concave portions.

The pressure-contact shape transfer processing apparatus illustrated in FIGS. 7A and 7B is an apparatus in which a mold member 5, a metallic member 6, an elastic member 7 and a positioning member 8 are arranged on a support member 9 in this order from the side closer to an electrophotographic photosensitive member 1 that is an object to be transferred. By the use of such a pressure-contact shape transfer processing apparatus, an insert member 4 is inserted into the electrophotographic photosensitive member 1, a load is applied to the insert member 4, and also the mold member 5 is moved in the Y direction illustrated in FIG. 7A by a slide mechanism or the like. In this way, the mold member 5 is continuously brought into pressure contact with the surface (outer peripheral surface) of the electrophotographic photosensitive member 1, while the electrophotographic photosensitive member 1 is rotated, and thereby the concave portions can be formed on the surface of the electrophotographic photosensitive member 1. From the viewpoint of efficiently transferring the shape, it is preferable to heat the mold member 5 and/or the electrophotographic photosensitive member 1.

FIGS. 8A and 8B illustrate a mold member 5 in which convex portions for forming the concave portions on the surface of the electrophotographic photosensitive member are provided on a fat plate. FIG. 8A illustrates a conventional example, and FIG. 8B illustrates a mold member used in the present disclosure. The mold member 5 in FIG. 8A has a first convex portion 51 in which a plurality of convex portions is provided at a predetermined pitch over the whole surface. The mold member 5 in FIG. 8B has a first convex portion 51 in which a plurality of convex portions is provided at a predetermined pitch. In addition, the mold member 5 in FIG. 8B has also a second convex portion 52 at an end in the X direction, in which a plurality of convex portions for forming concave portions are provided of which the depths are deep and which satisfy the above predetermined condition, at a predetermined pitch over the whole surface. The second convex portion 52 is a convex portion of which the height is higher than that of the convex portion provided in the first convex portion 51.

Figure 9A:
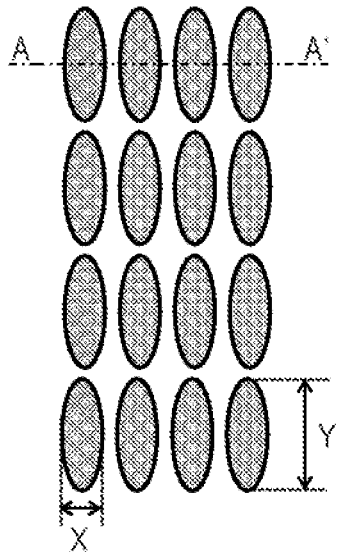
FIG. 9A illustrates one example of a convex shape on the mold member of the present disclosure.
Figure 9B:
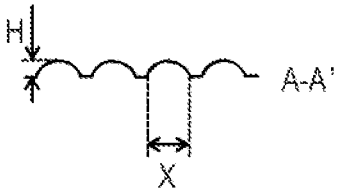
FIG. 9B illustrates one example of the convex shape on the mold member of the present disclosure.

FIGS. 9A and 9B schematically illustrate convex portions that are provided in the first convex portion 51 and the second convex portion 52 in FIGS. 8A and 8B. FIG. 9A illustrates a top view, and FIG. 9B illustrates a cross-sectional view taken along the line A-A' in FIG. 9A. When the convex portions provided in the first convex portion 51 and the second convex portion 52 are observed from above, various shapes can be formed as the shapes of the bottom faces. Examples of the shape include: a circle; an ellipse; polygons such as a triangle, a quadrangle and a hexagon; and shapes in which a curve is combined with a part or all of edges or sides of the polygon. In addition, the cross-sectional shape can be formed of various shapes such as a shape having an edge such as a triangle, a quadrangle and a polygon, a waveform formed of a continuous curve, and a shape in which a curve is combined with a part or all of the edge of the triangle, the quadrangle and the polygon.

Examples of the mold member 5 include: a metal or a resin film which has been subjected to fine surface working; a silicon wafer of which the surface is patterned with a resist; a resin film in which fine particles are dispersed; and a resin film having a fine surface shape, which is coated with a metal.

<Structure of Electrophotographic Photosensitive Member>

The cylindrical electrophotographic photosensitive member of the present disclosure has a support and a photosensitive layer formed on the support.

The photosensitive layer includes: a single-layer type photosensitive layer that contains a charge transport substance and a charge generation substance in the same layer; and a multilayer type (separated-function type) photosensitive layer that is separated into a charge generation layer containing a charge generation substance and a charge transport layer containing a charge transport substance. From the viewpoint of electrophotographic characteristics, the multilayer type photosensitive layer is preferable. In addition, the charge generation layer may also be a multilayer structure, and the charge transport layer may also be a multilayer structure.

It is preferable that the support have electroconductivity (electroconductive support). Examples of a material of the support include metals (alloys) such as iron, copper, gold, silver, aluminum, zinc, titanium, lead, nickel, tin, antimony, indium, chromium, aluminum alloys, and stainless steel. Alternatively, a support made from metal or a support made from plastics can be used, which has a coating film thereon formed by vacuum deposition with the use of aluminum, an aluminum alloy, an indium oxide-tin oxide alloy, or the like. In addition, a support can be used which is a plastic or paper impregnated with an electroconductive particle such as carbon black, a tin oxide particle, a titanium oxide particle, and a silver particle; or a support can also be used which is made from an electroconductive binder resin.

The surface of the support may be subjected to cutting treatment, surface roughening treatment, alumite treatment or the like, for the purpose of suppressing interference fringes due to scattering of laser light.

An electroconductive layer may be provided between the support and an undercoat layer or the photosensitive layer (charge generation layer or charge transport layer) which will be described later, for the purpose of suppressing interference fringes due to scattering of laser light, covering scratches on the support, or the like.

The electroconductive layer can be formed by applying a coating liquid for the electroconductive layer, which is obtained by dispersing an electroconductive particle together with a binder resin and a solvent, thereby forming a coating film, and drying and/or curing the obtained coating film.

Examples of the electroconductive particle to be used for the electroconductive layer include: particles of carbon black, acetylene black and metal such as aluminum, nickel, iron, nichrome, copper, zinc and sliver; and particles of metal oxides such as zinc oxide, titanium oxide, tin oxide, antimony oxide, indium oxide, bismuth oxide and ITO. Alternatively, indium oxide doped with tin, or tin oxide doped with antimony or tantalum may be used.

Examples of the solvent in the coating liquid for an electroconductive layer include ether-based solvents, alcohol-based solvents, ketone-based solvents and aromatic hydrocarbon solvents. It is preferable for a film thickness of the electroconductive layer to be 0.1 μm or more and 50 μm or less; is more preferable to be 0.5 μm or more and 40 μm or less; and is further preferable to be 1 μm or more and 30 μm or less.

Examples of the binder resin to be used for the electroconductive layer include: polymers and copolymers of vinyl compounds such as styrene, vinyl acetate, vinyl chloride, acrylic acid ester, methacrylic acid ester, vinylidene fluoride, and trifluoroethylene; a polyvinyl alcohol resin; a polyvinyl acetal resin; a polycarbonate resin; a polyester resin; a polysulfone resin; a polyphenylene oxide resin; a polyurethane resin; a cellulose resin; a phenol resin; a melamine resin; a silicon resin; an epoxy resin; and an isocyanate resin.

An undercoat layer (intermediate layer) may be provided between the support or the electroconductive layer and the photosensitive layer (charge generation layer and charge transport layer).

The undercoat layer can be formed by applying a coating liquid for the undercoat layer, which is obtained by dissolving a binder resin in a solvent, thereby forming a coating film, and drying the obtained coating film.

Examples of the binder resin to be used in the undercoat layer include: a polyvinyl alcohol resin, poly-N-vinylimidazole, a polyethylene oxide resin, ethyl cellulose, an ethylene-acrylic acid copolymer, casein, a polyamide resin, an N-methoxymethylated 6-nylon resin, a copolymerized nylon resin, a phenol resin, a polyurethane resin, an epoxy resin, an acrylic resin, a melamine resin and a polyester resin.

The undercoat layer may further contain a metal oxide particle. Examples of the metal oxide particle include particles that contain titanium oxide, zinc oxide, tin oxide, zirconium oxide and aluminum oxide. In addition, the metal oxide particle may be such a metal oxide particle that the surface of the metal oxide particle is treated with a surface treatment agent such as a silane coupling agent.

Examples of the solvent to be used for the coating liquid for the undercoat layer include organic solvents such as an alcohol-based solvent, a sulfoxide-based solvent, a ketone-based solvent, an ether-based solvent, an ester-based solvent, an aliphatic halogenated hydrocarbon-based solvent and an aromatic compound. It is preferable for a film thickness of the undercoat layer to be 0.05 μm or more and 30 μm or less, and is more preferable to be 1 μm or more and 25 μm or less. The undercoat layer may further contain a fine particle of an organic resin, and a leveling agent.

Examples of the charge generation substance to be used for the photosensitive layer include a pyrylium dye, a thiapyrylium dye, a phthalocyanine pigment, an anthanthrone pigment, a dibenzpyrenequinone pigment, a pyranthrone pigment, an azo pigment, an indigo pigment, a quinacridone pigment, an asymmetric quinocyanine pigment and a quinocyanine pigment. These charge generation substances may be used alone or in combination of two or more.

Examples of the charge transport substance to be used for the photosensitive layer include a hydrazone compound, an N,N-dialkylaniline compound, a diphenylamine compound, a triphenylamine compound, a triphenylmethane compound, a pyrazoline compound, a styryl compound, and a stilbene compound.

When the photosensitive layer is a multilayer type photosensitive layer, the charge generation layer can be formed by applying a coating liquid for the charge generation layer, which has been obtained by dispersing a charge generation substance with a binder resin and a solvent, thereby forming a coating film, and drying the obtained coating film.

It is preferable that the mass ratio of the charge generation substance to the binder resin be in a range of 1:0.3 to 1:4.

Examples of a dispersion treatment method include methods of using a homogenizer, ultrasonic dispersion, a ball mill, a vibration ball mill, a sand mill, an attritor and a roll mill.

The charge transport layer can be formed by applying a coating liquid for the charge transport layer, which has been obtained by dissolving a charge transport substance and a binder resin in a solvent, thereby forming a coating film, and drying the coating film.

Examples of the binder resin to be used for the charge generation layer and the charge transport layer include a polymer of a vinyl compound, polyvinyl alcohol, polyvinyl acetal, polycarbonate, polyester, polysulfone, polyphenylene oxide, polyurethane, a cellulose resin, a phenol resin, a melamine resin, a silicon resin and an epoxy resin.

It is preferable for a film thickness of the charge generation layer to be 5 μm or less, and is more preferable to be 0.1 μm or more and 2 μm or less.

It is preferable for a film thickness of the charge transport layer to be 5 μm or more and 50 μm or less, and is more preferable to be 10 μm or more and 35 μm or less.

In addition, on the photosensitive layer (charge transport layer in the case of multilayer type photosensitive layer), a protective layer may be provided which contains an electroconductive particle or a charge transport substance and a binder resin. When the protective layer is provided, the protective layer becomes the surface layer, and when the protective layer is not provided, the photosensitive layer becomes the surface layer. The protective layer may further contain an additive such as a lubricant. In addition, the resin (binder resin) itself of the protective layer may have electroconductivity or charge transport properties, and in this case, the protective layer may not contain the electroconductive particle or the charge transport substance other than the resin. The binder resin of the protective layer may be a thermoplastic resin, or a curable resin which is cured by heat, light, radioactive rays (electron beam or the like) or the like.

It is preferable for a film thickness of the protective layer to be 0.1 μm or more and 30 μm or less, and is more preferable to be 1 μm or more and 10 μm or less.

An additive can be added to each layer of the electrophotographic photosensitive member. Examples of the additive include: antidegradants such as an antioxidant and an ultraviolet absorber; particles of organic resins such as a particle of a fluorine atom-containing resin, and a particle of an acrylic resin; and inorganic particles such as silica, titanium oxide and alumina.

<Configuration of Process Cartridge and Electrophotographic Apparatus>

Figure 11:
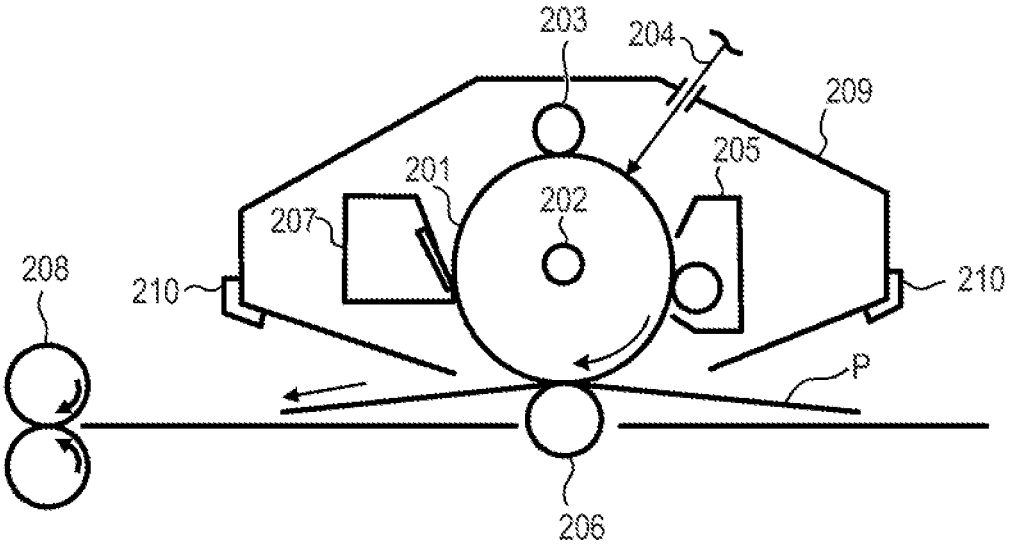
FIG. 11 illustrates a view illustrating one example of an electrophotographic apparatus provided with a process cartridge that includes the electrophotographic photosensitive member of the present disclosure.

FIG. 11 illustrates an example of an electrophotographic apparatus provided with a process cartridge having an electrophotographic photosensitive member of the present disclosure.

In FIG. 11, a cylindrical electrophotographic photosensitive member 201 of the present disclosure is rotationally driven around a shaft 202 in the direction of the arrow at a predetermined circumferential velocity (process speed). The surface of the electrophotographic photosensitive member 201 is uniformly charged to a predetermined positive or negative electric potential by a charging unit 203 (primary charging unit: charging roller for example) in a rotation process. Subsequently, the uniformly charged surface of the electrophotographic photosensitive member 201 is exposed to exposure light (image exposure light) 204 which is emitted from an exposure unit (image exposure unit) (not shown). In this way, an electrostatic latent image corresponding to the desired image information is formed on the surface of the electrophotographic photosensitive member 201.

The present disclosure shows a particularly great effect when a charging unit utilizing an electric discharge is used.

The electrostatic latent image formed on the surface of the electrophotographic photosensitive member 201 is subsequently developed (normal development or reversal development) with a toner in a developing unit 205, and a toner image is formed. The toner image formed on the surface of the electrophotographic photosensitive member 201 is transferred onto a transfer material P by a transfer bias given by a transfer unit (for example, a transfer roller) 206. At this time, the transfer material P is taken out from a transfer material supply unit (not shown) to a position (contact portion) between the electrophotographic photosensitive member 201 and the transfer unit 206 in synchronization with the rotation of the electrophotographic photosensitive member 201, and is fed. In addition, a bias voltage that has a polarity opposite to that of the electric charge held by the toner is applied to the transfer unit from a bias power source (not shown).

The transfer material P onto which the toner image has been transferred is separated from the surface of the electrophotographic photosensitive member, is conveyed to a fixing unit 208, is subjected to a fixing process of the toner image, and is thereby printed out to the outside of the electrophotographic apparatus, as an image formed product (print or copy).

After the toner image has been transferred, the surface of the electrophotographic photosensitive member 201 is subjected to the removal of deposits such as a transfer residual toner by a cleaning unit 207 having a cleaning blade, and is changed to a cleaned surface. For information, the cleaning blade is arranged in contact with (abuts on) the whole region of the surface of the electrophotographic photosensitive member 201 in the generatrix direction of the electrophotographic photosensitive member 201. Furthermore, the cleaned surface of the electrophotographic photosensitive member 201 is subjected to charge elimination treatment by pre-exposure light (not shown) emitted from a pre-exposure unit (not shown), and then is repeatedly used for the image formation. For information, as is illustrated in FIG. 11, when the charging unit 203 is a contact charging unit using a charging roller or the like, the pre-exposure unit is not necessarily required. In the present disclosure, the above specified electrophotographic photosensitive member 201 is used, and accordingly, the friction force between the surface of the electrophotographic photosensitive member and the cleaning blade is reduced, the abrasion of the tip of the cleaning blade is suppressed, and satisfactory cleaning characteristics can be maintained over a long period of time.

In the present disclosure, a plurality of structure elements among structure elements that are selected from the group consisting of the electrophotographic photosensitive member 201, the charging unit 203, the developing unit 205, the transfer unit 206, the cleaning unit 207 and the like are housed in a vessel, and are integrally supported as a process cartridge. In addition, the process cartridge can be configured to be detachably attachable to a main body of an electrophotographic apparatus such as a copying machine or a laser beam printer. In FIG. 11, the electrophotographic photosensitive member 201, the charging unit 203, the developing unit 205 and the cleaning unit 207 are integrally supported to form a cartridge, and structure a process cartridge 209 that is detachably attachable to the main body of the electrophotographic apparatus by use of a guide unit 210 such as a rail of the main body of the electrophotographic apparatus.

When the electrophotographic apparatus is a copying machine or a printer, the exposure light 204 is reflected light from or transmitted light through a document. Alternatively, the exposure light 204 is light emitted from the exposure unit which reads a document with a sensor, generates a signal, generates a scanning laser beam according to the signal, or drives an LED array or a liquid crystal shutter array.

EXAMPLES

The present disclosure will be described in more detail below with reference to specific Examples. Note that "part" in the Examples means "part by mass". In addition, the electrophotographic photosensitive member is also simply referred to as "photosensitive member" below.

(Production Example of Photosensitive Member)

An aluminum cylinder having a diameter of 29.92 mm, and a length of 357.5 mm was used as a cylindrical base substance 2 (cylindrical support).

Next, 100 parts of a zinc oxide particle (specific surface area: 19 $m^2/g$, and powder resistance: $4.7\times10^6$ Ωcm) as a metal oxide were mixed with 500 parts of toluene and stirred. To the mixture, 0.8 parts of a silane coupling agent (compound name: N-2-(aminoethyl)-3-aminopropylmethyl dimethoxysilane, trade name: KBM602, manufactured by Shin-Etsu Chemical Co., Ltd.) were added, and the resultant mixture was stirred for 6 hours. After that, the toluene was distilled off under reduced pressure, the residue was heated and dried at 130° C. for 6 hours, and a zinc oxide particle was obtained of which the surface was treated.

Next, 15 parts of a butyral resin (trade name: BM-1, manufactured by Sekisui Chemical Co., Ltd.) were prepared as a polyol resin, and 15 parts of a blocked isocyanate (trade name: Sumidur 3175, manufactured by Sumika Bayer Urethane Co., Ltd.) were provided. These materials were dissolved in a mixed solution of 73.5 parts of methyl ethyl ketone and 73.5 parts of 1-butanol. To the solution, 80.8 parts of the surface-treated zinc oxide particle and 0.8 parts of 2,3,4-trihydroxy benzophenone (manufactured by Tokyo Chemical Industry Co., Ltd.) were added, and the mixture was dispersed for 3 hours in an atmosphere of 23±3° C. by a sand mill apparatus which used glass beads having a diameter of 0.8 mm. After the dispersion, 0.01 parts of silicone oil (trade name: SH28PA, manufactured by Dow Corning Toray Silicone Co., Ltd.) and 5.6 parts of a cross-linked polymethyl methacrylate (PMMA) particle (trade name: TECHPOLYMER SSX-102, manufactured by Sekisui Kasei Co., Ltd., and average primary particle size of 2.5 μm) were added to the dispersion liquid, the mixture was stirred, and a coating liquid for an undercoat layer was prepared.

With the coating liquid for the undercoat layer, the above cylindrical base substance 2 was dip-coated, the obtained coating film was dried at 160° C. for 40 minutes, and an undercoat layer was formed which had a film thickness of 18 μm.

Next, such materials were prepared as 20 parts of a hydroxygallium phthalocyanine crystal (charge generation substance) which had a crystal form having strong peaks at 7.4° and 28.2° of Bragg angles 2θ±0.2° in CuKα characteristic X-ray diffraction, 0.2 parts of a calixarene compound represented by the following structural formula (A), 10 parts of polyvinyl butyral (trade name: S-LEC BX-1, manufactured by Sekisui Chemical Co., Ltd.), and 600 parts of cyclohexanone. These materials were charged into a sand mill which used glass beads having a diameter of 1 mm, were subjected to dispersion treatment for 4 hours, and then 700 parts of ethyl acetate were added thereto. Thereby, a coating liquid for the charge generation layer was prepared. With this coating liquid for the charge generation layer, the undercoat layer was dip-coated, the obtained coating film was dried at 80° C. for 15 minutes, and a charge generation layer was formed which had a film thickness of 0.17 μm.

(A)

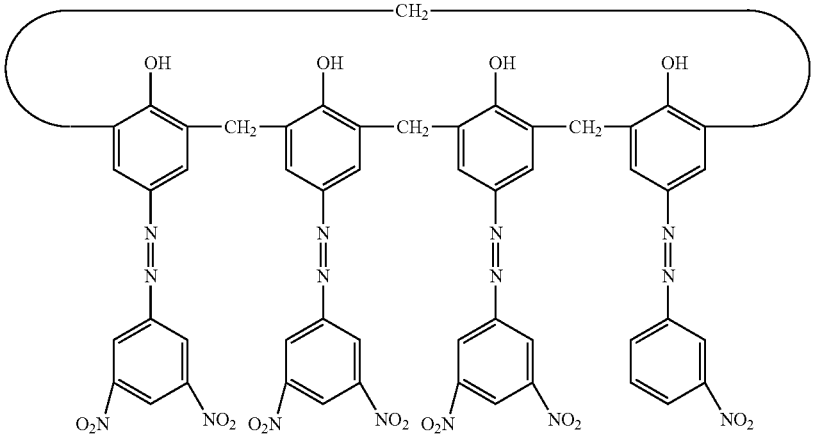

Next, such materials were prepared as 30 parts of a chemical compound represented by the following structural formula (B)(charge transport substance), 60 parts of a chemical compound represented by the following structural formula (C) (charge transport substance), 10 parts of a chemical compound represented by the following structural formula (D), 100 parts of a polycarbonate resin (trade name: Jupilon Z400, manufactured by Mitsubishi Engineering-Plastics Corporation, which is bisphenol Z type of polycarbonate), and 0.02 parts of polycarbonate represented by the following structural formula (E) (viscosity average molecular weight Mv: 20000). These materials were dissolved in a mixed solvent of 600 parts of mixed xylene and 200 parts of dimethoxymethane, and thereby a coating liquid for the charge transport layer was prepared. With this coating liquid for the charge transport layer, the charge generation layer was dip-coated, thereby a coating film was formed, and the obtained coating film was dried at 100° C. for 30 minutes. Thereby, a charge transport layer was formed which had a film thickness of 18 μm.

(B)

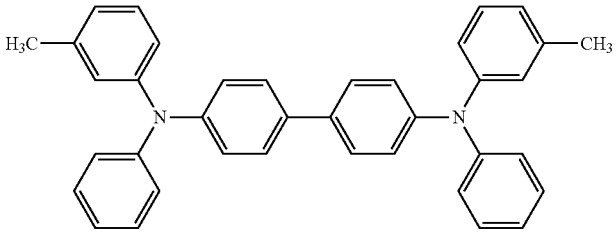

(C)

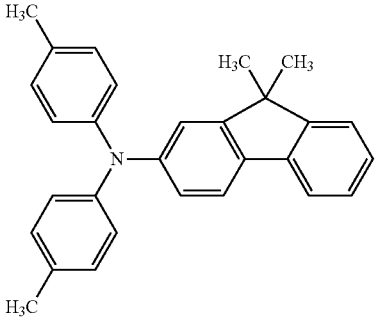

-continued (D)

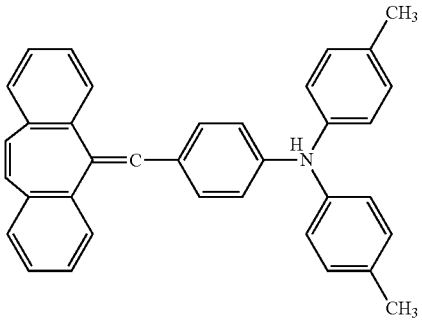

(E)

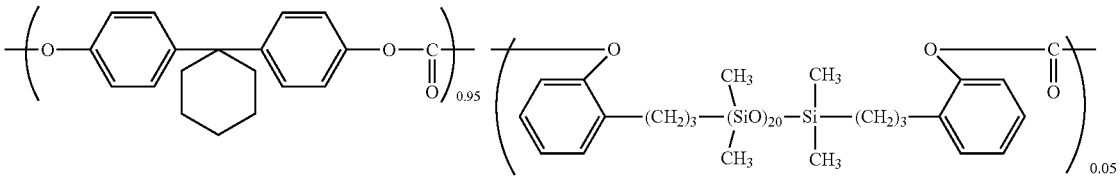

(In Formula (E), 0.95 and 0.05 are molar ratios (copolymerization ratios) of two structural units.)

Next, a mixed solvent of 20 parts of 1,1,2,2,3,3,4-heptafluorocyclopentane (trade name: ZEORORA® H, manufactured by Zeon Corporation) and 20 parts of 1-propanol were filtered through a polyflon filter (trade name: PF-490, manufactured by Advantec Toyo Kaisha, Ltd.). After that, 90 parts of a hole transporting compound (charge transport substance) represented by the following structural formula (F), 70 parts of 1,1,2,2,3,3,4-heptafluorocyclopentane, and 70 parts of 1-propanol were added to the above mixed solvent. The resultant mixture was filtered through a polyflon filter (trade name: PF-020, manufactured by Advantec Toyo Kaisha, Ltd.), and a coating liquid for a second charge transport layer (protective layer) was prepared. With the coating liquid for the second charge transport layer, the charge transport layer was dip-coated, and the obtained coating film was dried at 50° C. for 6 minutes in the atmosphere. After that, in nitrogen, the coating film was irradiated with an electron beam for 1.6 seconds under conditions of an accelerating voltage of 70 kV and an absorbed dose of 8000 Gy, while the support (object to be irradiated) was rotated at 200 rpm. Subsequently, the temperature in nitrogen was raised from 25° C. to 125° C. for 30 seconds, and the coating film was heated. A concentration of oxygen in the atmosphere was 15 ppm during the irradiation with the electron beam and the subsequent heating. Next, the resultant coating film was subjected to heat treatment at 100° C. for 30 minutes in the atmosphere, and a second charge transport layer (protective layer) was formed which was cured by the electron beam and had a film thickness of 5 μm.

(F)

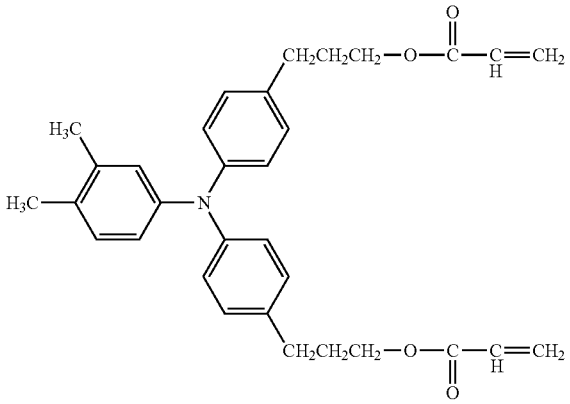

In addition, as for the coating films of all the coated layers in the production of the present Examples, the lower end portions in the pull-up direction of the coating in the end of the respective coating processes were subjected to peeling treatment with the use of a solvent. In addition, the coating regions of all the layers were controlled so as to become regions between 1 mm from the upper end portions and 1 mm from the lower end portions in the pull-up direction of the coating of the cylindrical base substance 2.

In this way, a cylindrical electrophotographic photosensitive member was produced at the time before a concave portion shape was formed on its surface (electrophotographic photosensitive member at the time before formation of concave portion shape).

Example 1

(Surface Working)

An insert member 4 as illustrated in FIG. 7A was inserted into the thus obtained cylindrical electrophotographic photosensitive member 1 at the time before the concave portion shape was formed, in a state of being previously heated to 55° C. At the time of the insertion, the insert member 4 was inserted so that a center position in the axial direction of the electrophotographic photosensitive member 1 and a center position in the axial direction of the insert member 4 coincided with each other. As a material of the insert member, a cemented carbide was used of which the main material was tungsten carbide having a longitudinal elasticity modulus of $540\times10^3$ N/mm$^2$.

On a support member 9, each member was arranged in order of a mold member 5, a metal layer 6, an elastic layer 7 and a positioning member 8, from the side closer to the electrophotographic photosensitive member 1 that is an object to be transferred. The material of the support member 9 was determined to be SUS430, and a heater for heating was installed in the inner part. In addition, a slide mechanism was provided in the support member 9, which moved in the Y direction in the FIG. 7A. The positioning member 8 was a plate made from SS400 having a thickness of 6 mm, and was used after the surface was subjected to electroless nickel plating. Silicon rubber having a thickness of 8 mm was used as the elastic layer 7. A flat plate was used as the metal layer 6, which was made from SUS301CSP-3/4H and had a thickness of 2 mm.

Here, the mold member 5 to be used in the present Example will be described. As the mold member 5, a flat plate mold of a nickel material having a thickness of 300 μm was used as illustrated in FIG. 8B. In addition, on the surface of the mold member 5 in contact with the electrophotographic photosensitive member 1 which is illustrated in FIGS. 8A and 8B, a first convex portion 51 and second convex portion 52 which would be described later were provided at respective positions illustrated in FIG. 8B. In addition, all of the mold members S were determined to be used so that the illustrated longitudinal direction was fit to the axial direction of the electrophotographic photosensitive member, and the length 53 in the illustrated X direction of the convex portions in total of the first convex portion and the second convex portion was set at 345 mm. In addition, the length 54 in the illustrated Y direction of the convex portion in the FIG. 8B was set at 100 mm.

Figure 10A:
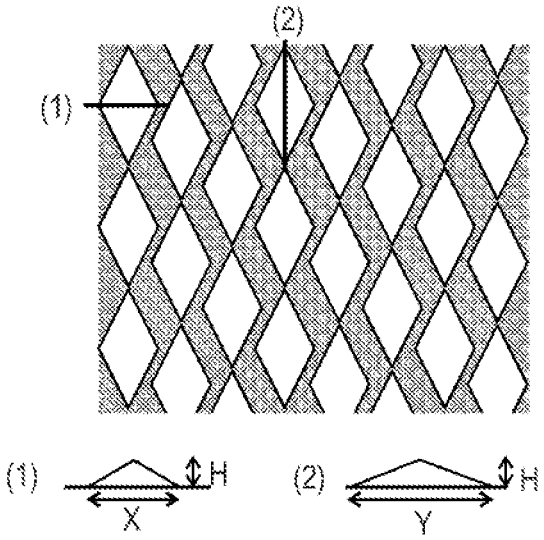
FIG. 10A illustrates one example of the convex shape on the mold member of the present disclosure.
Figure 10B:
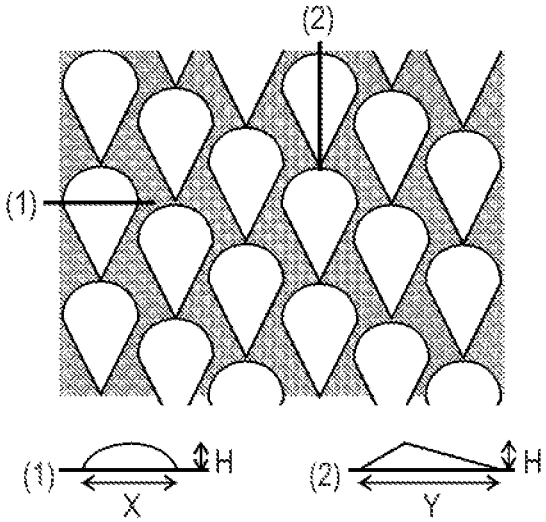
FIG. 10B illustrates one example of the convex shape on the mold member of the present disclosure.

In Example 1, the mold member 5 illustrated in FIG. 8B was used. The mold member 5 has a first convex portion 51 and second convex portion 52 on its surface. The first convex portion has a shape illustrated in FIG. 10A, and in the present Example, as is shown in Table 1, diameter in X direction: 30 μm, diameter in Y direction: 75 μm, area ratio of 50%, and height H: 1.6 μm. The second convex portion has a shape illustrated in FIG. 10B, and similarly as is shown in Table 1, diameter in X direction: 30 μm, diameter in Y direction: 75 μm, area ratio of 50%, and height H: 5.6 μm. The second convex portions are arranged with a width of 21 mm from both ends in the X direction, respectively. (Widths of 55 and 56 in FIG. 8B)

These were fixed in the positional relationship illustrated in FIG. 7A. Note that the mold member 5 was fixed so that a direction of the left side illustrated in FIG. 8B became a direction of the left side illustrated in FIGS. 7A and 7B. In addition, in a state in which the upper surface was installed so as to become substantially horizontal, a temperature of the heater of the support member 9 was raised, and was controlled so that the surface of the mold member 5 became 150° C.

In order that the surface of the electrophotographic photosensitive member 1 is pressed against the mold member 5, a load mechanism not shown was provided at both end portions of the insert member 4. For each of the load mechanisms, a guide rail and a ball screw were provided in the vertical direction, and furthermore, a connection support member which moved up and down was provided so as to be connected to the ball screw and the guide rail. A servomotor was connected to a lower side of the ball screw, and was rotated so that the connection support member was moved up and down along the guide rail. The end portions of the connection support member and the insert member 4 are connected by a spherical joint. In addition, the spherical joint and the connection support member were connected to each other via a load cell so that the amount of load applied to each of both ends of the insert member 4 could be monitored.

In surface working of the electrophotographic photosensitive member 1, the electrophotographic photosensitive member 1 was pressed against the mold member 5 by use of the load mechanism, and the mold member 5 was moved in the Y direction illustrated in FIG. 7A by the slide mechanism. Thereby, the mold member 5 transferred its shape onto the surface of the electrophotographic photosensitive member 1 while rolling the electrophotographic photosensitive member 1.

At the time of the working, firstly, the position of the support member 9 was adjusted so that the left end portion illustrated in FIGS. 8A and 8B of the convex portion of the mold member 5 came right below the electrophotographic photosensitive member 1. Next, a servomotor of the loading mechanism was rotated to move the insert member 4 toward the mold member 5 at a speed of 20 mm/sec (Vzl). After that, at the point in time when the electrophotographic photosensitive member 1 was brought into contact with the mold member 5, and the load cell detected that the amount of load applied to the insert member 4 reached 6000 N, the movement of the load mechanism was stopped. Next, the support member 9 was started to move at a speed of 10 mm/sec in the Y direction of FIG. 7A, and the electrophotographic photosensitive member 1 was driven and rotated in the clockwise direction as illustrated in FIG. 7A. In this way, the convex portion on the surface of the mold member 5 was transferred onto the surface of the electrophotographic photosensitive member 1. Then, at the point in time when the support member 9 moved 95 mm while maintaining this state, the slide mechanism was stopped, then the insert member 4 was moved by the load mechanism at a speed of 20 mm/sec in a direction away from the mold member 5, and the electrophotographic photosensitive member 1 was separated from the mold member 5. In this way, the mold member 5 transferred the convex portion on its surface onto the surface of the electrophotographic photosensitive member 1 while rolling the electrophotographic photosensitive member 1, and thereby the concave portion corresponding to the convex portion on the surface of the mold member 5 was formed on the surface of the electrophotographic photosensitive member 1. By the above method, a cylindrical electrophotographic photosensitive member was produced which had the concave portion formed on its surface.

(Measurement of Surface Working Result)

Subsequently, the concave portion was measured which was formed on the surface of the electrophotographic photosensitive member by the surface working as described above. This measurement method will be described below.

The surface of the obtained electrophotographic photosensitive member having the obtained concave portion was magnified by a lens having a magnification of 50 times of a laser microscope (manufactured by Keyence Corporation, trade name: VK-9500) and was observed, and the concave portion and the flat portion provided on the surface of the electrophotographic photosensitive member were determined as described above. At the time of observation, the laser microscope was adjusted so that there was no gradient of the electrophotographic photosensitive member in the longitudinal direction, and so that the apex of the arc of the electrophotographic photosensitive member was in focus, in the circumferential direction. Then, the magnified and observed images were linked by an image linking application, and information about the whole surface of the electrophotographic photosensitive member was obtained. In addition, the obtained result was subjected to image analysis by attached software, and height data by image processing was selected, and was subjected to filter processing by filter type median.

By the above observation, such values were determined as a depth of each concave portion formed on the surface of the electrophotographic photosensitive member, an average value of the maximum widths of the openings in the circumferential direction, an average value of the widths of the openings in the axial direction, an angle of the apex (intersection point) formed by two straight lines, and an opening area. In addition, the region A and the region B were formed on the surface of the electrophotographic photosensitive member so as to correspond to the first convex portion and the second convex portion of the mold member; and accordingly, the respective lengths in the axial direction were measured, and the position in the axial direction of the region A was determined when the length of the electrophotographic photosensitive member was regarded as 1.00.

The results are shown in Table 2.

It should be noted that as a result of having observed the surface of the electrophotographic photosensitive member with another laser microscope (manufactured by Keyence Corporation, trade name: X-200) in the same manner as in the above case, the same result was obtained as in the case where the above laser microscope (manufactured by Keyence Corporation, trade name: VK-9500) was used. In the following Examples, a laser microscope (manufactured by Keyence Corporation, trade name: VK-9500) and a lens of having a magnification of 50 times were used for the observation of the surface of the electrophotographic photosensitive member.

(Evaluation)

The electrophotographic photosensitive member of which the surface was worked in Example 1 as described above was mounted on a modified machine of an electrophotographic copying machine iR-ADV C5255 manufactured by Canon Inc., and the passing of a toner and an external additive was evaluated. The electrophotographic photosensitive member was mounted on a drum cartridge for the electrophotographic copying machine iR-ADV C5255 so that the upper end side of the coating of the electrophotographic photosensitive member became the back side of the modified machine of the electrophotographic copying machine iR-ADV C5255.

As for the cleaning blade, a cleaning blade was used as it was, which was mounted on a drum cartridge for the electrophotographic copying machine iR-ADV C5255 (hardness: 80 JISA°, and rebound resilience at 25° C.: 35%). An abutment angle (narrow angle) between the electrophotographic photosensitive member and a lower surface of a blade of the cleaning blade was set at 25°, and an abutment pressure on the electrophotographic photosensitive member was set at 10 gf/cm. A toner for evaluation was determined to be black, and the toner was used which had a weight average particle size of 4.0 μm.

The evaluation was performed in an environment of a temperature of 15° C. and a relative humidity of 10%. In this evaluation, an image was formed in a state in which an intermediate transfer member was removed, and the image having a density of 100% was continuously formed on 10 sheets; then the intermediate transfer member was attached again, and a screen image having a density of 30% was output as a halftone image, and streaks on the image, which originate in the passing of the toner and the external additive, were evaluated according to the following criteria. As for the evaluation rank, A is most excellent, and E is most inferior.

A: the streak does not occur on the image.

B: an image is obtained on which a pattern appears that is suspected to be the streak, but it cannot be determined whether or not the pattern is clearly a level of the streak.

C: an extremely light streak can be slightly recognized on the image.

D: a slight streak occurs on the image.

E: a clear streak occurs on the image.

Subsequently, a squeaking of the cleaning blade was evaluated, as an evaluation of whether the stress applied to the cleaning blade is inhomogeneous or homogeneous in the longitudinal direction. A drum cartridge similar to that used in the evaluation of the passing of the toner and the external additive was used, except that the abutment pressure of the cleaning blade against the electrophotographic photosensitive member was changed to 40 gf/cm. The evaluation was performed in an environment of a temperature of 22° C. and a relative humidity of 75%, and an image having an image ratio of 1% was continuously formed on 100 thousand sheets. In this evaluation, sheets of paper to be evaluated having the A4 size were longitudinally fed (in state in which short side of sheet was positioned perpendicular to direction of conveyance of sheet).

The squeaking of the cleaning blade during the evaluation was evaluated according to the following criteria. As for the evaluation rank, A is most excellent, and D is most inferior.

A: squeaking of the cleaning blade does not occur.

B: squeaking of the cleaning blade is suspected, but the level cannot be clearly determined.

C: squeaking of the cleaning blade slightly occurs.

D: squeaking of the cleaning blade clearly occurs.

The results are shown in Table 2.

TABLE 1

| | Mold member | | | | | | | |
|---|---|---|---|---|---|---|---|---|
| | | | | Second convex portion | | | | |
| | Length in X direction of convex portion mm | Length 55 in X direction of second convex portion mm | Length 56 in X direction of second convex portion mm | Convex shape | Presence or absence of intersection point | Presence or absence of shape which gradually becomes shallow toward intersection point from deepest point | Diameter in X direction μm | Diameter in Y direction μm |
| Example 1 | 345 | 21 | 21 | 10-2 | Present | Present | 30 | 75 |
| Example 2 | 345 | 21 | 21 | 10-2 | Present | Present | 20 | 20 |
| Example 3 | 345 | 21 | 21 | 10-2 | Present | Present | 30 | 200 |
| Example 4 | 345 | 21 | 21 | 10-2 | Present | Present | 30 | 75 |
| Example 5 | 345 | 21 | 21 | 10-2 | Present | Present | 30 | 75 |
| Example 6 | 345 | 21 | 21 | 10-2 | Present | Present | 30 | 75 |
| Example 7 | 345 | 21 | 21 | 10-2 | Present | Present | 30 | 75 |
| Example 8 | 345 | 21 | 21 | 10-2 | Present | Present | 30 | 75 |
| Example 9 | 345 | 21 | 21 | 10-2 | Present | Present | 30 | 75 |
| Example 10 | 345 | 21 | 21 | 10-2 | Present | Present | 30 | 75 |
| Example 11 | 345 | 21 | 21 | 10-2 | Present | Present | 30 | 75 |
| Example 12 | 345 | 21 | 21 | 10-2 | Present | Present | 30 | 75 |
| Example 13 | 345 | 21 | 21 | 10-2 | Present | Present | 30 | 75 |
| Example 14 | 345 | 21 | 21 | 9-1 | Absent | Absent | 30 | 75 |
| Example 15 | 345 | 21 | 21 | 10-2 | Present | Present | 30 | 75 |
| Example 16 | 327 | 12 | 12 | 10-2 | Present | Present | 30 | 75 |
| Comparative Example 1 | 345 | — | — | — | — | — | — | — |
| Comparative Example 2 | 345 | — | — | — | — | — | — | — |

| | Mold member | | | | | | | | |
|---|---|---|---|---|---|---|---|---|---|
| | | | First convex portion | | | | | | |
| | Second convex portion | | | | | | | | |
| | Area ratio % | Height μm | Convex shape | Presence or absence of intersection point | Presence or absence of shape which gradually becomes shallow toward intersection point from deepest point | Diameter in X direction μm | Diameter in Y direction μm | Area ratio % | Height μm |
| Example 1 | 50 | 5.6 | 10-2 | Present | Present | 30 | 75 | 50 | 1.6 |
| Example 2 | 50 | 5.6 | 10-2 | Present | Present | 30 | 75 | 50 | 1.6 |
| Example 3 | 50 | 5.6 | 10-2 | Present | Present | 30 | 75 | 50 | 1.6 |

TABLE 1-continued

| | | | | | | | | | |
|---|---|---|---|---|---|---|---|---|---|
| Example 4 | 50 | 4.0 | 10-2 | Present | Present | 30 | 75 | 50 | 1.6 |
| Example 5 | 50 | 8.0 | 10-2 | Present | Present | 30 | 75 | 50 | 1.6 |
| Example 6 | 5 | 4.0 | 10-2 | Present | Present | 30 | 75 | 50 | 1.6 |
| Example 7 | 65 | 8.0 | 10-2 | Present | Present | 30 | 75 | 50 | 1.6 |
| Example 8 | 50 | 5.6 | 10-2 | Present | Present | 20 | 20 | 50 | 1.6 |
| Example 9 | 50 | 5.6 | 10-2 | Present | Present | 30 | 200 | 50 | 1.6 |
| Example 10 | 50 | 5.6 | 10-2 | Present | Present | 30 | 75 | 50 | 0.6 |
| Example 11 | 50 | 5.6 | 10-2 | Present | Present | 30 | 75 | 50 | 3 |
| Example 12 | 50 | 5.6 | 10-2 | Present | Present | 30 | 75 | 5 | 0.6 |
| Example 13 | 50 | 5.6 | 10-2 | Present | Present | 30 | 75 | 65 | 3 |
| Example 14 | 50 | 5.6 | 9-1 | Absent | Absent | 30 | 75 | 65 | 3 |
| Example 15 | 40 | 5.6 | 10-2 | Present | Present | 30 | 75 | 50 | 1.6 |
| Example 16 | 50 | 5.6 | 10-2 | Present | Present | 30 | 75 | 50 | 1.6 |
| Comparative Example 1 | — | — | 10-2 | Present | Present | 30 | 75 | 50 | 3 |
| Comparative Example 2 | — | — | 10-2 | Present | Present | 30 | 75 | 50 | 3.4 |

TABLE 2

| | Width in axial direction of region A (upper end of coating) mm | Position of region A when whole length is set at 1 | Width in axial direction of region A (lower end of coating) mm | Position of region A when whole length is set at 1 | Width in axial direction of region B mm | Region A | | |
|---|---|---|---|---|---|---|---|---|
| | | | | | | Width in axial direction W1 μm | Width in circumferential direction L1 μm | Area of concave portions $mm^2$ |
| Example 1 | 21 | 0.02~0.08 | 21 | 0.92~0.98 | 303 | 30 | 75 | 990 |
| Example 2 | 21 | 0.02~0.08 | 21 | 0.92~0.98 | 303 | 20 | 20 | 990 |
| Example 3 | 21 | 0.02~0.08 | 21 | 0.92~0.98 | 303 | 30 | 200 | 990 |
| Example 4 | 21 | 0.02~0.08 | 21 | 0.92~0.98 | 303 | 30 | 75 | 990 |
| Example 5 | 21 | 0.02~0.08 | 21 | 0.92~0.98 | 303 | 30 | 75 | 990 |
| Example 6 | 21 | 0.02~0.08 | 21 | 0.92~0.98 | 303 | 30 | 75 | 99 |
| Example 7 | 21 | 0.02~0.08 | 21 | 0.92~0.98 | 303 | 30 | 75 | 1286 |
| Example 8 | 21 | 0.02~0.08 | 21 | 0.92~0.98 | 303 | 30 | 75 | 990 |
| Example 9 | 21 | 0.02~0.08 | 21 | 0.92~0.98 | 303 | 30 | 75 | 990 |
| Example 10 | 21 | 0.02~0.08 | 21 | 0.92~0.98 | 303 | 30 | 75 | 990 |
| Example 11 | 21 | 0.02~0.08 | 21 | 0.92~0.98 | 303 | 30 | 75 | 990 |
| Example 12 | 21 | 0.02~0.08 | 21 | 0.92~0.98 | 303 | 30 | 75 | 990 |
| Example 13 | 21 | 0.02~0.08 | 21 | 0.92~0.98 | 303 | 30 | 75 | 990 |
| Example 14 | 21 | 0.02~0.08 | 21 | 0.92~0.98 | 303 | 30 | 75 | 990 |
| Example 15 | 21 | 0.02~0.08 | 21 | 0.92~0.98 | 303 | 30 | 75 | 792 |

TABLE 2-continued

| | | | | | | | | |
|---|---|---|---|---|---|---|---|---|
| Example 16 | 12 | 0.04~0.08 | 12 | 0.92~0.96 | 303 | 30 | 75 | 565 |

| | Region A | | Region B | | | | | Evaluation | |
|---|---|---|---|---|---|---|---|---|---|
| | Area ratio a1 % | Depth d1 μm | Width in axial direction W2 μm | Width in circumferential direction L2 μm | Area of concave portions $mm^2$ | Area ration a2 % | Depth d2 μm | Passing | Squeaking of blade |
| Example 1 | 50 | 2.8 | 30 | 75 | 14279 | 50 | 1.6 | A | A |
| Example 2 | 50 | 2.8 | 30 | 75 | 14279 | 50 | 1.6 | A | A |
| Example 3 | 50 | 2.8 | 30 | 75 | 14279 | 50 | 1.6 | A | A |
| Example 4 | 50 | 1.7 | 30 | 75 | 14279 | 50 | 1.6 | A | B |
| Example 5 | 50 | 4 | 30 | 75 | 14279 | 50 | 1.6 | A | A |
| Example 6 | 5 | 1.7 | 30 | 75 | 14279 | 50 | 1.6 | A | C |
| Example 7 | 65 | 4 | 30 | 75 | 14279 | 50 | 1.6 | A | A |
| Example 8 | 50 | 2.8 | 20 | 20 | 14279 | 50 | 1.6 | A | A |
| Example 9 | 50 | 2.8 | 30 | 200 | 14279 | 50 | 1.6 | A | A |
| Example 10 | 50 | 2.8 | 30 | 75 | 14279 | 50 | 0.6 | A | A |
| Example 11 | 50 | 2.8 | 30 | 75 | 14279 | 50 | 3 | B | A |
| Example 12 | 50 | 2.8 | 30 | 75 | 1428 | 5 | 0.6 | A | A |
| Example 13 | 50 | 2.8 | 30 | 75 | 18562 | 65 | 3 | B | A |
| Example 14 | 50 | 2.8 | 30 | 75 | 18562 | 65 | 3 | C | A |
| Example 15 | 40 | 2.8 | 30 | 75 | 14279 | 50 | 1.6 | A | A |
| Example 16 | 50 | 2.8 | 30 | 75 | 14279 | 50 | 1.6 | A | A |

Examples 2 to 16

In the same manner as in Example 1, cylindrical electrophotographic photosensitive members were produced at the time before the respective concave portion shapes were formed on the respective surfaces (electrophotographic photosensitive member at the time before formation of concave portion shape); and each of the surfaces of the electrophotographic photosensitive members was worked in the same manner as in Example 1 by use of a mold member having a first convex portion and a second convex portion of which configurations were each shown in Table 1. The electrophotographic photosensitive member on the surface of which the concave portion shape was already formed was subjected to the measurement and the evaluation in the same manner as in Example 1. The measurement results and evaluation results are each shown in Table 2.

Comparative Examples 1 and 2

In the same manner as in Example 1, cylindrical electrophotographic photosensitive members were produced at the time before the respective concave portion shapes were formed on the respective surfaces (electrophotographic photosensitive member at the time before formation of concave portion shape). In Comparative Examples 1 and 2, each of the surfaces of the electrophotographic photosensitive members was worked in the same manner as in Example 1, except that the mold member having only the first convex portion illustrated in FIG. 8A was used, instead of the mold member having the first convex portion and the second convex portion illustrated in FIG. 8B, which was used in Examples 1 to 16. The electrophotographic photosensitive member on the surface of which the concave portion shape was already formed was subjected to the measurement and the evaluation in the same manner as in Example 1. The measurement results and evaluation results are each shown in Table 3.

TABLE 3

| | Width in axial direction of surface-worked region mm | Concave portion: Width in axial direction μm | Concave portion: Width in circumferential direction μm | Concave portion: Area $mm^2$ | Concave portion: Area ratio % | Concave portion: Depth μm | Evaluation: Passing | Evaluation: Squeaking of blade |
|---|---|---|---|---|---|---|---|---|
| Comparative Example 1 | 345 | 30 | 75 | 16258 | 50 | 1.5 | B | D |

TABLE 3-continued

| | Concave portion | | | | | | Evaluation | |
|---|---|---|---|---|---|---|---|---|
| | Width in axial direction of surface-worked region mm | Width in axial direction μm | Width in circumferential direction μm | Area $mm^2$ | Area ratio % | Depth μm | Passing | Squeaking of blade |
| Comparative Example 2 | 345 | 30 | 75 | 16258 | 50 | 1.7 | E | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-056468, filed Mar. 26, 2020, which is hereby incorporated by reference herein in its entirety.

What is claimed is:

1. A cylindrical electrophotographic photosensitive member having a plurality of concave portions on a surface thereof, comprising:

a region A having a plurality of concave portions, at an end portion in an axial direction of the electrophotographic photosensitive member; and a region B having a plurality of concave portions different from those in the region A, in a direction toward a center of the axial direction of the electrophotographic photosensitive member from the region A, wherein in the region A, an average value L1 of maximum widths of opening parts of the concave portions in a circumferential direction of the electrophotographic photosensitive member is 20 μm to 200 μm, an average value W1 of maximum widths of opening parts of the concave portions in an axial direction of the electrophotographic photosensitive member satisfies $W1 \leq L1$, an average value d1 of depths of the concave portions is 1.7 μm to 4.0 μm, and an area ratio a1 of the concave portions is 5% or more and 65% or less; and in the region B, an average value L2 of maximum widths of opening parts of the concave portions in a circumferential direction of the electrophotographic photosensitive member is 20 μm to 200 μm, an average value W2 of maximum widths of opening parts of the concave portions in the axial direction of the electrophotographic photosensitive member satisfies $W2 \leq L2$, an average value d2 of depths of the concave portions is 0.3 μm to 1.5 μm, and an area ratio a2 of the concave portions is 5% or more and 65% or less.

2. The electrophotographic photosensitive member according to claim 1, wherein when a length of the axial direction of the electrophotographic photosensitive member is defined as 1.00 and the position on the electrophotographic photosensitive member in the axial direction is expressed by a value of 0.00 to 1.00, the position on the electrophotographic photosensitive member comprising the region A in the axial direction is 0.02 to 0.08 or 0.92 to 0.98.

3. The electrophotographic photosensitive member according to claim 1, wherein a contour of the opening of the concave portion has an apex having an angle α which exceeds 0° and is 90° or less at least on an upstream side in a rotation direction of the electrophotographic photosensitive member; the width of the contour of the opening of the concave portion in the axial direction of the electrophotographic photosensitive member decreases toward the apex from the portion at which the width becomes maximum; and the depth of the concave portion decreases toward the apex from the deepest point of the concave portion, when the concave portion is viewed from the axial direction.

4. The electrophotographic photosensitive member according to claim 1, wherein the area ratio a1 of the concave portion in the region A is 40% or more and 65% or less.

5. A process cartridge integrally supporting a cylindrical electrophotographic photosensitive member having a plurality of concave portions on a surface thereof and at least one unit selected from the group consisting of a charging unit, a developing unit and a cleaning unit; and being detachably attachable to a main body of an electrophotographic apparatus, wherein the electrophotographic photosensitive member comprises: a region A having a plurality of concave portions, at an end portion in an axial direction thereof; and a region B having a plurality of concave portions different from those in the region A, in a direction toward a center of the axial direction of the electrophotographic photosensitive member from the region A, wherein in the region A, an average value L1 of maximum widths of opening parts of the concave portions in a circumferential direction of the electrophotographic photosensitive member is 20 μm to 200 μm, an average value W1 of maximum widths of opening parts of the concave portions in an axial direction of the electrophotographic photosensitive member satisfies $W1 \leq L1$, an average value d1 of depths of the concave portions is 1.7 μm to 4.0 μm, and an area ratio a1 of the concave portions is 5% or more and 65% or less; and in the region B, an average value L2 of maximum widths of opening parts of the concave portions in a circumferential direction of the electrophotographic photosensitive member is 20 μm to 200 μm, an average value W2 of maximum widths of opening parts of the concave portions in the axial direction of the electrophotographic photosensitive member satisfies $W2 \leq L2$, an average value d2 of depths of the concave portions is 0.3 μm to 1.5 μm, and an area ratio a2 of the concave portions is 5% or more and 65% or less.

6. An electrophotographic apparatus comprising:

a cylindrical electrophotographic photosensitive member having a plurality of concave portions on a surface thereof; a charging unit; an exposure unit; a developing unit; a transfer unit; and a cleaning unit having a cleaning blade that is arranged in contact with the electrophotographic photosensitive member, wherein the electrophotographic photosensitive member comprises: a region A having a plurality of concave portions, at an end portion in an axial direction thereof; and a region B having a plurality of concave portions different from those in the region A, in a direction toward a center of the axial direction of the electrophotographic photosensitive member from the region A, wherein in the region A, an average value L1 of maximum widths of opening parts of the concave portions in a circumferential direction of the electrophotographic photosensitive member is 20 μm to 200 μm, an average value W1 of maximum widths of opening parts of the concave portions in an axial direction of the electrophotographic photosensitive member satisfies $W1 \leq L1$, an average value d1 of depths of the concave portions is 1.7 μm to 4.0 μm, and an area ratio a1 of the concave portions is 5% or more and 65% or less; and in the region B, an average value L2 of maximum widths of opening parts of the concave portions in a circumferential direction of the electrophotographic photosensitive member is 20 μm to 200 μm, an average value W2 of maximum widths of opening parts of the concave portions in the axial direction of the electrophotographic photosensitive member satisfies $W2 \leq L2$, an average value d2 of depths of the concave portions is 0.3 μm to 1.5 μm, and an area ratio a2 of the concave portions is 5% or more and 65% or less, wherein an end portion of the image formable region in the axial direction of the electrophotographic photosensitive member is comprised in the region B.

* * * * *